US005484082A

United States Patent [19]

Casper et al.

[11] Patent Number: 5,484,082

[45] Date of Patent: Jan. 16, 1996

[54] PORTABLE LINERLESS LABEL DISPENSER

[75] Inventors: Mark Casper; Stephen Michalovic, both of Williamsville, N.Y.

[73] Assignee: Moore Business Forms, Inc., Grand Island, N.Y.

[21] Appl. No.: 325,529

[22] Filed: Oct. 19, 1994

[51] Int. Cl.[6] ..... A47F 1/04

[52] U.S. Cl. ..... 221/305; 221/1; 221/73; 221/312 C; 206/395; 206/408; 206/416; 229/198.1

[58] Field of Search ..... 221/305, 312 C, 221/70, 71, 73, 1; 53/397; 206/407, 408, 415, 416, 395, 396; 229/198.1, 198.2, 198.3

[56] References Cited

U.S. PATENT DOCUMENTS

| | | | |
|---|---|---|---|
| 2,017,405 | 10/1935 | Pantalone | 206/395 |
| 2,276,296 | 3/1942 | Flood | 221/73 |
| 2,293,187 | 8/1942 | Becker | 206/395 X |
| 2,333,116 | 11/1943 | Newsom | 229/198.1 X |
| 2,372,245 | 3/1945 | Avery . | |
| 2,912,140 | 11/1959 | Cole . | |
| 3,231,130 | 1/1966 | Foote . | |
| 3,344,976 | 10/1967 | Mason | 229/198.1 X |
| 3,685,644 | 8/1972 | Cothran et al. | 206/408 |
| 3,698,600 | 10/1972 | Foote | 221/70 |
| 4,306,687 | 12/1981 | Hadtke | 242/55.53 |
| 4,431,139 | 2/1984 | Barnsbee et al. | 206/395 X |
| 4,444,313 | 4/1984 | Tyson | 206/407 X |
| 4,467,974 | 8/1984 | Crim | 242/55.53 |
| 4,549,689 | 10/1985 | Bailey | 206/395 X |
| 4,772,355 | 9/1988 | Leahy | 221/73 X |
| 4,821,918 | 4/1989 | Turner | 221/73 X |
| 4,824,517 | 4/1989 | Leahy | 221/73 X |
| 4,865,196 | 9/1989 | Buelens et al. | 206/409 |
| 4,954,210 | 9/1990 | Desmond | 221/71 X |
| 5,246,111 | 9/1993 | Shibazaki et al. | 206/408 X |

FOREIGN PATENT DOCUMENTS

| | | | |
|---|---|---|---|
| 975335 | 9/1975 | Canada | 221/70 X |

*Primary Examiner*—William E. Terrell
*Assistant Examiner*—Dean A. Reichard
*Attorney, Agent, or Firm*—Nixon & Vanderhye

[57] ABSTRACT

A simple, inexpensive, and easy to construct label dispenser is provided for linerless labels. The dispenser is made from a rectangular strip of cardboard or paper board having four parallel fold lines defining the strip into first through fifth panels and with first and second openings in the first and fifth panels and a third opening in the third panel. The strip is folded about the fold lines to form an open ended rectangular parallelepiped with the first and fifth panels in face to face engagement. A plastic plug is inserted into the first and second openings, making a friction fit with them and holding the first and fifth panels together. A second plug is inserted into the third opening, and the plugs define a pivot axis for a roll of linerless labels. One of the labels is separated from the roll and the adhesive face of it is placed in engagement with the second panel outer face and parts of the fifth and third panels to facilitate holding of the blank in a rectangular parallelepiped configuration, while providing a non-stick tear-off surface for other labels in the roll mounted for rotation about an axis defined by the plugs.

21 Claims, 2 Drawing Sheets

FIG. 1
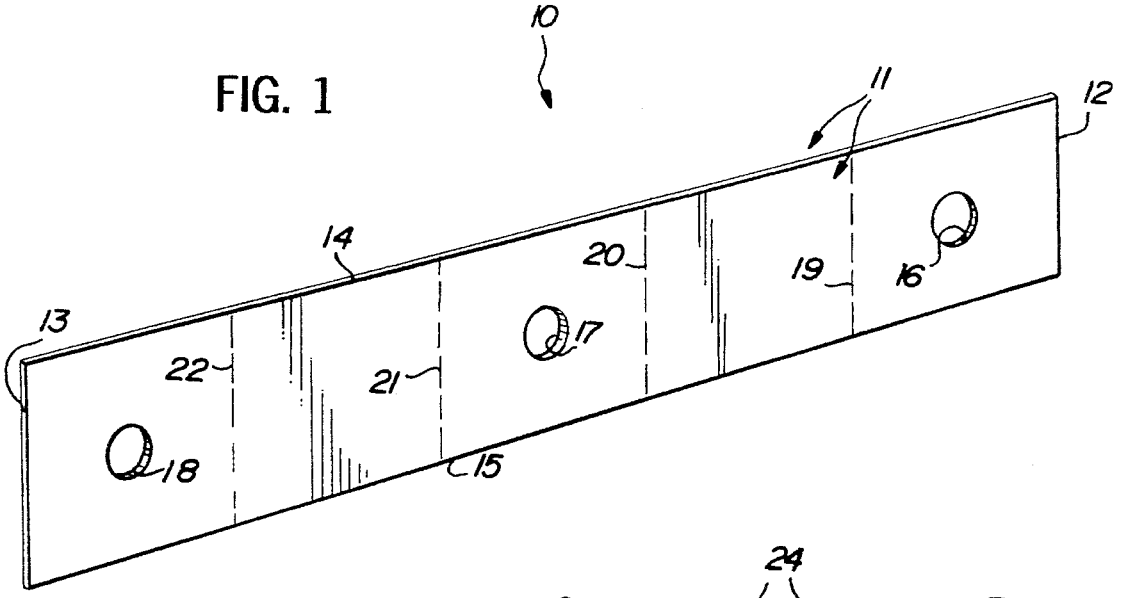
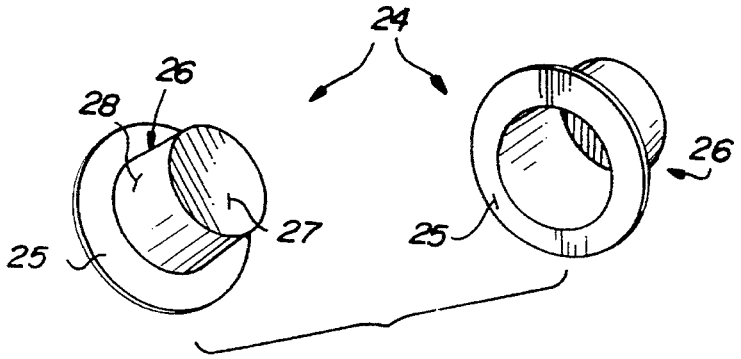
FIG. 2
FIG. 3
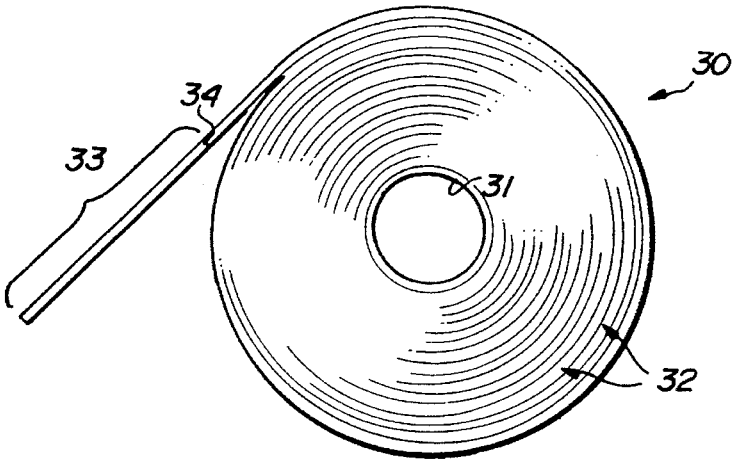

PORTABLE LINERLESS LABEL DISPENSER

BACKGROUND AND SUMMARY OF THE INVENTION

Because of environmental and other advantages, linerless labels are becoming increasingly more popular. However even for limited use applications it is convenient to use a dispenser for dispensing linerless labels so that the lead edge of each of the labels can, in turn, easily be found to facilitate ready detachment and use of the labels. While a number of good industrial dispensers exist for linerless labels, there are many users or potential users that would like to have the advantages of a dispenser but cannot cost justify an industrial dispenser because of limited usage, or the like.

According to the present invention a dispenser particularly suited for linerless labels is provided which is extremely low cost, easy to produce, assemble, and utilize, yet effectively dispenses linerless labels. The materials of which the dispenser according to the invention are constructed are extremely inexpensive, and readily available and the dispenser according to the invention is so inexpensive that it may be used simply to dispense a single roll of linerless labels and then discarded. However it does have sufficient integrity that if desired it can be used to dispense a number of rolls of linerless labels, it being a simple and easy procedure to remove the core of a dispensed roll and substitute a new roll.

According to one aspect of the present invention a creasable and foldable sheet material blank for constructing a label dispenser is provided. The blank comprises the following elements: A rectangular strip of creasable and foldable sheet material having first and second ends and first and second sides, the sides substantially parallel to each other. Four fold lines formed in the strip each extending generally perpendicular to the first and second sides defining first through filth panels from the first end to the second end. And, first and second openings formed in the first and fifth panels, the openings aligned with each other when the strip is folded about the first through fourth fold lines with the first and fifth panels in face to face engagement and opposite and generally parallel to the third panel.

Typically a third opening is provided in the third panel aligned with the first and second openings when the strip is folded as indicated above. The sheet material of which the dispenser is made is preferably conventional paper board or cardboard, e.g. paper board having a weight of about 1–1.2 lbs. per 1,000 square inches. The fold lines may be perforations, score lines, creases, or any other suitable construction which facilitates pre-determined positioning and accurate folding of the blank. Typically the first and second ends are parallel to the fold lines and to each other.

The blank according to the present invention is typically provided in combination with plastic plugs and a roll of linerless labels. Linerless labels have a first face which includes pressure sensitive adhesive, and a second face—opposite the first face—which is of silicone, chromium, or some other release material that does not adhere well to pressure sensitive adhesive (particularly the adhesive of the linerless labels) so that the labels may readily be separated from the roll.

First and second plugs are typically provided which make friction fits with the flint and second openings—holding the first and fifth panels together—and with the third opening, respectively, the plastic plugs also defining an axis of rotation for the roll of linerless labels, for example providing shaft stubs which are inserted into the roll core.

An attachment strip with an adhesive face and a release material face is also preferably utilized extending across the face of the second panel and engaging parts of the fifth and third panels to help hold the dispenser in assembled condition, and to provide a nonstick tear-off surface for the labels to be dispensed. Preferably the attachment strip is one of the linerless labels.

Alternatively, or in addition to, the provision of one linerless label to define a surface for ready separation of the linerless labels of the roll (particularly at perforation lines between the labels) a cutting edge may be mounted on the second or fourth panel. A serrated cutting edge would typically be provided if there are no perforations between the individual labels of the roll.

According to another aspect of the present invention a label dispenser assembly is provided comprising the following elements: An open ended rectangular parallelepiped having first through fourth sides, and an open interior communicating the open ends thereof. First and second shaft stubs extending into the open interior from the first and third sides of the label dispenser, and substantially concentric with each other and defining an axis of rotation. And, a roll of linerless labels mounted on the shaft stubs for rotation about the axis, so that the labels on the roll of linerless labels may be dispensed one at a time by moving the labels into contact with at least a portion of the second side to detach a panel from a trailing label in the roll.

The tear-off surface for linerless labels may typically be one of the labels itself, as described above, and the shaft stubs may be the plastic plugs as described above, which of course also can cooperate with openings in the first and third sides to give structural integrity to the parallelepiped.

According to yet another aspect of the present invention a method of dispensing linerless labels is provided, utilizing the blank and other components as described above. The method comprises the following steps: (a) Folding the strip about the fold lines to form an open ended rectangular paralellepiped, the first and fifth panels in face to face engagement with each other and the first through third openings aligned with each other. (b) Inserting the plastic plugs into the third opening, and the first and second openings, respectively, the plugs making interference fits with the openings and one of the plugs holding the panels together in the rectangular parallelepiped configuration due to the interference fit with the first and fifth panels first and second openings. (c) Separating one of the linerless labels from the roll of linerless labels and bringing the adhesive face of the separated label into contact with the second panel and parts of the fifth and third panels so that the release face of the separated label forms a non-stick tear-off surface on a second panel and so that the separated label facilitates folding the panels in a rectangular parallelepiped configuration. And, (d) mounting the roll of linerless labels within the rectangular paralellepiped by the plastic plugs so that the roll is rotatable with respect to the axis defined by the plugs, and the labels may be dispensed one at a time from the roll by bringing them into contact with the second panel.

It is the primary object of the present invention to provide the simple, cost-effective, yet effective dispensing of linerless labels. This and other objects of the invention will become clear from an inspection of the detailed description of the invention and from the appended claims.

BRIEF DESCRIPTION OF THE DRAWINGS

FIG. 1 is a top perspective view of an exemplary sheet material blank that may be folded to produce a label dispenser according to the present invention;

FIG. 2 are top and bottom perspective views of two plastic plugs utilizable with the blank of FIG. 1 to construct a label dispenser according to the present invention;

FIG. 3 is a side view of an exemplary roll of linerless labels utilized according to the present invention;

DETAILED DESCRIPTION OF THE DRAWINGS

Figure 4:
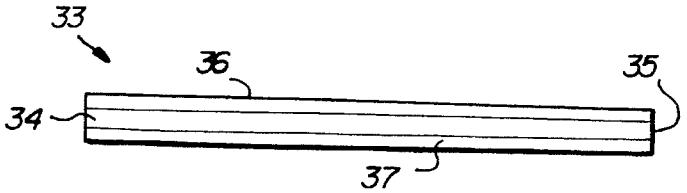
FIG. 4 is a side view, with the components greatly enlarged for clarity of illustration, of one exemplary label detached from the roll of linerless labels of FIG. 3.

An exemplary rectangular strip 10 of creasable and foldable sheet material 11 is illustrated in blank form in FIG. 1. The strip—which preferably is of paper board (e.g. having a weight of about 1–1.2 lbs. per 1,000 square inches or cardboard—has first and second ends 12, 13 which are preferably substantially parallel to each other and perpendicular to side edges 14, 15. First (16), second (18), and third (17) openings are formed in the strip 10, the openings 16–18 preferably being circular in cross-section and of approximately the same size as the opening in the core of linerless labels to be dispensed via a dispenser made from the strip 10. The holes 16–18 are made—preferably—by die cutting, and the die cutting blanks may be left in the holes 16–18 until the strip 10 is to be utilized by the ultimate purchaser.

Four fold lines 19–22 are provided in the sheet material 11. Each of the fold lines 19–22 is parallel to the other fold lines and substantially perpendicular to the side edges 14, 15 (and typically parallel to the ends 12, 13 too). The fold lines 19–22 may be of any construction that facilitates proper positioning and ready folding along predetermined lines. For example the fold lines 19–22 may comprise perforations, score lines, or creases in the paper board 11. The fold lines 19–22 define the strip 10 into five panels, the first panel between edge 12 and fold line 19, the fourth panel between fold lines 19–20, the third panel between fold lines 20–21, the second panel between fold lines 21–22, and the fifth panel between fold line 22 and second end 13. The opening 16 is in the first panel 12–19, the opening 17 is in the third panel 20–21, and the opening 18 is in the fifth panel 22–13.

Plastic plugs, preferably two in number and shown generally by reference numeral 24 in FIG. 2, are provided. The plugs 24 each have an enlarged generally circular flange or ring 25 at one end thereof, a body 26 defined by a closed end 27, and a cylinder 28, and are preferably hollow. The plugs 24, which may also be referred to as hubs or shaft stubs, are preferably constructed of low cost plastic, such as those made by the Caplugs Division of Protective Closures Co., Inc. The diameter of the cylindrical bodies 26 are preferably substantially the same as the interior diameter of the cardboard core 31 of a roll 30 of linerless labels—shown collectively at 32 in FIG. 3. Also the diameter of the cylindrical bodies 26 is essentially the same as the diameters of the openings 16–18 so that an interference (friction) fit is provided therebetween. The larger circular flanges 25 will not fit into the openings 16–18.

The roll 30 of linerless labels is essentially conventional, preferably each individual label 33 being separated by a perforation line 34—or other line of weakness—from each of the rest of the labels 32. An exemplary label 33 is seen—greatly exaggerated in thickness for clarity of illustration—in FIG. 4. It comprises label stock 35 which has a silicone or other release material coating 36 on one face thereof, and a coating 37 of pressure sensitive adhesive on the opposite face thereof. The properties of the coating 36 are such that it will not readily adhere to the adhesive 37, but rather will readily release therefrom. The adhesive 37 may be permanent, repositional, or removable adhesive, and the release coating 36 may be silicone based, chromium based, or of any other conventional construction.

Figure 5:
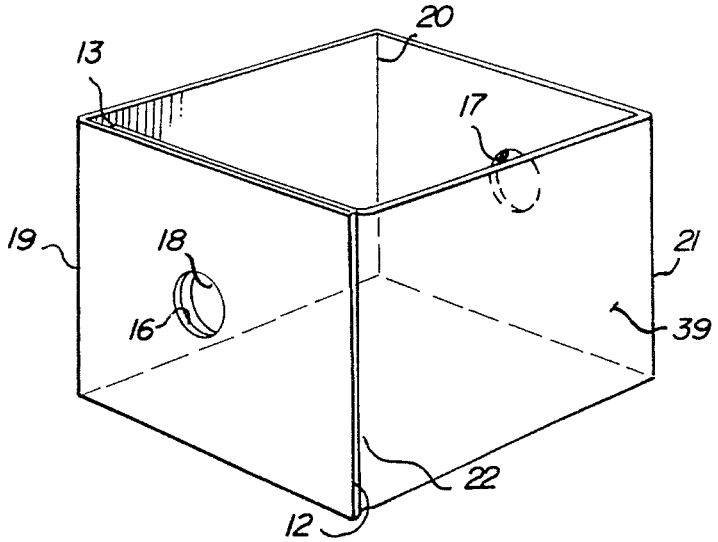
FIG. 5 is a top perspective view of the blank of FIG. 1 folded into a rectangular parallelepiped and prior to being secured in the rectangular parallelepiped configuration.

FIG. 5 illustrates a rectangular parallelepiped label dispenser that is constructed from the blank of FIG. 1 by folding about the fold lines 19–22. In this configuration the first panel 12–19 and the fifth panel 22–13 are in face to face engagement with each other with the openings 16, 18 therein aligned, and also aligned with the opening 17 in the third panel 20–21. The exterior face 39 is provided for the panel 21–22.

Figure 6:
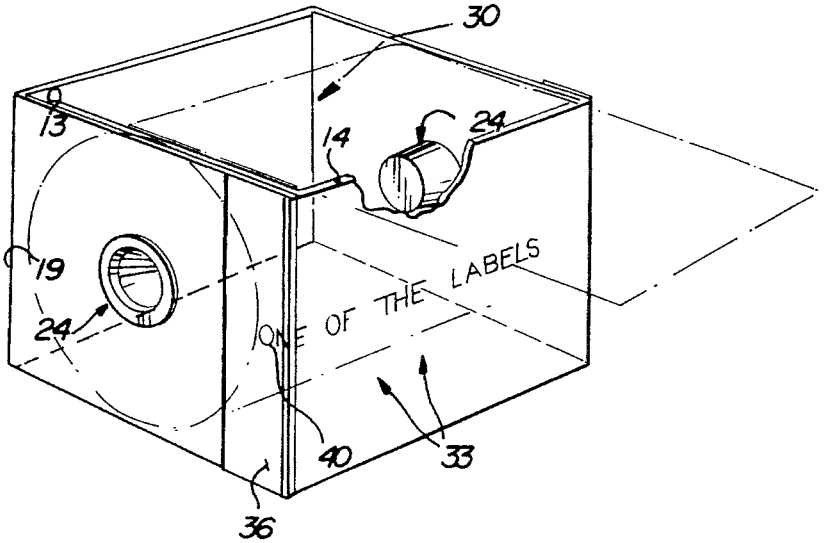
FIG. 6 is a top perspective view of a label dispenser according to the present invention which comprises the rectangular parallelepiped of FIG. 5 secured in place with the plastic plugs of FIG. 2 and the label of FIG. 4, and showing the roll of linerless labels from FIG. 3 in dotted line in operative association therewith.
Figure 7:
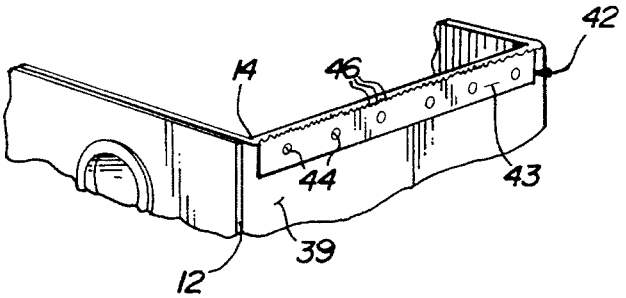
FIG. 7 is a partial view like that of FIG. 6 showing a different embodiment in which a serrated blade is used to facilitate label dispensing.

FIG. 6 illustrates the rectangular parallelepiped label dispenser of FIG. 5 fully assembled. The plastic plugs 24 have been inserted through the openings 16, 18 and 17, respectively, the friction fit provided by the plug 24 for the opening 16–18 holding the entire rectangular parallelepiped label dispenser in place. Also one of the linerless labels 33 has been removed from the roll 30 and the pressure sensitive adhesive 37 face thereof has been brought into is contact with parts of the panel 12–19 and the panel 20–21, as well as into contact with the face 39 of panel 21–22 so that the release material coating 36 thereof is on the outside of the rectangular parallelepiped, particularly at the face 39, and provides a non-stick surface to which the adhesive 37 from subsequent labels 33 that are being dispensed will not stick. Note that each of the labels 33 typically has indicia 40 on (or under and visible through) the coating 36. The label 33 in FIG. 6 also—in addition to providing a surface that facilitates tearing of each of the labels 33 from the roll 30 at the perforation line 34 thereof when aligned with the edge 14 of the rectangular parallelepiped panel 21–22—facilitates holding the strip 10 in the rectangular parallelepiped configuration illustrated in FIG. 6.

While it is preferred that one of the labels 33 be provided to form the holding facilitating and release surface providing function of the parallelepiped seen in FIG. 6, some other type of attachment strip that has the same properties as the label 33 may be utilized in its place, particularly if the labels to be dispensed from the roll 30 are not of a convenient size for that purpose. In that case the attachment strip (which may initially be lined or unlined) may be provided with a kit including the blank 10 and the plugs 24, to provide a construction of the rectangular parallelepiped label dispenser. The roll 30 relatively freely rotates about the shaft stub formed by the plugs 24 extending into the core 31, with a free label always exposed for ready dispensing, as seen by the dotted line configuration in FIG. 6.

While the provision of the label 33 as illustrated in FIG. 6 is preferred, under some circumstances instead of the label 33, or in addition thereto, or even on an opposite panel side edge, a cutter 42 may be provided. The cutter 42 is particularly useful if perforation lines 34 are not provided between the labels 33. The cutter 42 includes a metal or hard plastic blade 43 which is held in place on the face 39 on edge 14 or 15 by adhesive or a plurality of rivets 44 extending through openings in the material 43 and into the cardboard or paper board defining the face 39. Preferably the cutting edge 46 is serrated.

It will thus be seen that according to the present invention a simple, low cost, yet effective label dispenser—particularly desirable for dispensing linerless labels—is provided, as well as a method of dispensing linerless labels utilizing a dispenser. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures, devices, and processes.

What is claimed is:

1. A creasable and foldable sheet material blank for constructing a label dispenser, comprising:

a rectangular strip of creasable and foldable sheet material having first and second ends and first and second sides, said sides substantially parallel to each other;

four fold lines formed in said strip each extending generally perpendicular to said first and second sides defining first through fifth panels from said first end to said second end; and first and second openings formed in said first and fifth panels, said openings aligned with each other when said strip is folded about said first through fourth fold lines with said first and fifth panels in face to face engagement and opposite and generally parallel to said third panel.

2. A label dispenser blank as recited in claim 1 further comprising a third opening, of substantially the same size as the first and second openings, formed in said third panel so that said first through third openings are substantially concentric with each other when said strip is folded about said first through fourth fold lines with said first and fifth panels in face to face engagement and opposite and generally parallel to said third panel.

3. A label dispenser blank as recited in claim 1 wherein said rectangular strip is of paper board or cardboard.

4. A label dispenser blank as recited in claim 3 wherein said fold lines comprise perforations or score lines or creases.

5. A label dispenser blank as recited in claim 4 wherein said first and second ends are substantially parallel to each other and to said fold lines.

6. A label dispenser blank as recited in claim 1 in combination with a first plug making a friction fit with said first and second openings, said blank folded about said first through fourth fold lines with said first and fifth panels in face to face engagement and opposite and generally parallel to said third panel, and said first plug holding said first and fifth panels in face to face engagement.

7. A label dispenser combination as recited in claim 6 further comprising a third opening of substantially the same size and shape as said first and second openings disposed in said third panel and substantially concentric therewith; and further comprising a second plug disposed on said third opening and forming, with said first plug, a pivot axis for a roll of labels.

8. A label dispenser combination as recited in claim 7 wherein said plugs are of plastic having a generally cylindrical body portion and a flange which extends radially outwardly from said cylindrical body portion and has a larger diameter than said cylindrical body portion; and wherein said openings are substantially circular in cross-section.

9. A label dispenser combination as recited in claim 7 further comprising an attachment strip, said attachment strip having a first face with pressure sensitive adhesive thereon and a second face, opposite said first face, of adhesive release material; said attachment strip having said adhesive face thereof engaging said second panel and portions of said third and fifth panels to assist in holding said panels in place and also to provide a non-stick tear-off surface for labels to be dispensed by said label dispenser combination.

10. A label dispenser combination as recited in claim 9 further comprising a roll of linerless labels mounted by said plugs for rotation with respect to said panels about said axis.

11. A label dispenser combination as recited in claim 10 wherein said attachment strip comprises one of said linerless labels.

12. A label dispenser combination as recited in claim 7 further comprising a roll of linerless labels mounted by said plugs for rotation with respect to said panels about said axis.

13. A label dispenser blank as recited in claim 2 further comprising a label cutting edge mounted on said second panel.

14. A label dispenser blank as recited in claim 1 in combination with a first plug making a friction fit with first and second openings, said blank folded about said first through fourth fold lines with said first and fifth panels in face to face engagement and opposite and generally parallel to said third panel, and said first plug holding said first and fifth panels in face to face engagement; further comprising a third opening of substantially the same size and shape as said first and second openings disposed in said third panel and substantially concentric therewith; and further comprising a second plug disposed in said third opening and forming a pivot axis for a roll of labels with said first plug.

15. A label dispenser assembly comprising:

an open ended rectangular parallelepiped having first through fourth sides, and an open interior communicating said open ends thereof;

first and second shaft stubs extending into said open interior from said first and third sides of said label dispenser, and substantially concentric with each other and defining an axis of rotation; and a roll of linerless labels mounted on said shaft stubs for rotation about said axis, so that said labels on said roll of linerless labels may be dispensed one at a time by moving said labels into contact with at least a portion of said second side to detach a label from a trailing label in said roll.

16. A label dispenser as recited in claim 15 wherein said second side of said parallelepiped has an outer face; and further comprising a release material coating extending outwardly from said second side outer face.

17. A label dispenser as recited in claim 16 wherein said release coating on said second side outer face comprises a linerless label release coating face, said linerless label having an adhesive face opposite said release coating face, and said adhesive face in engagement with parts of said first and third sides and said second side to enhance the structural integrity of said parallelepiped.

18. A label dispenser as recited in claim 17 wherein said shaft stubs comprise first and second plastic plugs, each plug having a cylindrical body and a circular flange at one end of said cylindrical body and having a diameter larger than the diameter of said cylindrical body, said cylindrical bodies passing through aligned openings in said first and third sides and said flanges engaging outer faces of said first and third sides.

19. A label dispenser as recited in claim 18 further comprising two panels with aligned openings formed in said first side of said parallelepiped, one of said plastic plugs making an interference fit with said aligned opening and holding said panels together at said first side.

20. A method of dispensing linerless labels from a roll of linerless labels, each linerless label having a first face comprising pressure sensitive adhesive and a second face opposite the first face of release material; utilizing a rectangular strip of creasable and foldable sheet material having four fold lines that are parallel to each other and defining first through fifth panels with first and second openings formed in the first and fifth panels and a third opening formed in the third panel; and a pair of plastic plugs; said method comprising the steps of:

(a) folding the strip about the fold lines to form an open ended rectangular paralellepiped, the first and fifth panels in face to face engagement with each other and the first through third openings aligned with each other;

(b) inserting the plastic plugs into said third opening, and the first and second openings, respectively, the plugs making interference fits with the openings and one of said plugs holding the panels together in the rectangular parallelepiped configuration due to the interference fit with the first and fifth panel's first and second openings;

(c) separating one of the linerless labels from the roll of linerless labels and bringing the adhesive face of the separated label into contact with the second panel and parts of the fifth and third panels so that the release face of the separated label forms a non-stick tear-off surface on the second panel and so that the separated label facilitates folding the panels in a rectangular parallelepiped configuration; and (d) mounting the roll of linerless labels within the rectangular paralellepiped by the plastic plugs so that the roll is rotatable with respect to axis defined by the plugs, and the labels may be dispensed one at a time from the roll by bringing them into contact with the second panel.

21. A label dispenser assembly comprising:

a dispenser of cardboard or paperboard, having an external surface;

a roll of linerless labels mounted by said dispenser, each linerless label having a first surface of release material and a second surface of pressure sensitive adhesive; and a linerless label having a pressure sensitive adhesive thereof adhered to the exterior of said dispenser in a position for a linerless label of said roll to be brought into operative contact therewith during dispensing.

* * * * *